US006659917B1

(12) United States Patent
Tacx

(10) Patent No.: US 6,659,917 B1
(45) Date of Patent: Dec. 9, 2003

(54) BICYCLE TRAINER

(75) Inventor: Jacobus Hubertus Johannes Tacx, Wassenaar (NL)

(73) Assignee: Technische Industrie Tacx B.V., Wassenaar (NL)

( * ) Notice: Subject to any disclaimer, the term of this patent is extended or adjusted under 35 U.S.C. 154(b) by 64 days.

(21) Appl. No.: 10/140,964

(22) Filed: May 7, 2002

(51) Int. Cl.[7] ..... A63B 21/00
(52) U.S. Cl. ..... 482/63; 482/908
(58) Field of Search ..... 482/57–65, 908; 434/61

(56) References Cited

U.S. PATENT DOCUMENTS

| | | | | | |
|---|---|---|---|---|---|
| 4,028,915 | A | * | 6/1977 | Stahl | 70/233 |
| 4,400,038 | A | * | 8/1983 | Hosokawa | 301/124.2 |
| 4,969,642 | A | * | 11/1990 | Phillips | 482/61 |
| 5,026,047 | A | * | 6/1991 | Kosecoff | 482/59 |
| 5,152,729 | A | * | 10/1992 | Phillips | 482/61 |
| 5,494,390 | A | * | 2/1996 | Gonzales | 411/368 |

* cited by examiner

*Primary Examiner*—Stephen R. Crow

(74) *Attorney, Agent, or Firm*—Jeffrey D. Myers

(57) ABSTRACT

The invention relates to a quick release mechanism for securing and releasing a bicycle in a trainer, wherein said mechanism engages and secures the rear hub area of a bicycle without disassembly of said bicycle, comprising:

(a) a housing adapted to slidably receive at least part of a piston, wherein said housing is mounted on a first hub supporting leg of said trainer;

(b) a piston nesting within the housing and being slidable therein, wherein said piston has a first end and a second end, said first end bearing a first means for capturing a bicycle wheel hub;

(c) means for slidably moving side piston within said housing in order to extend said first end toward the hub of a bicycle to secure said bicycle, including a lever mounted at the second end of said piston;

(d) a second means for capturing said bicycle wheel hub, said capturing means being mounted on a second hub supporting leg of said trainer, wherein the hub supporting legs are mutually spaced to allow a bicycle wheel mounted on a bicycle wheel to be located and captured therebetween, wherein (e) the housing and the piston have a cooperating groove and protrusion or peg, whereby the groove is embodied with a pitch so as to cause that rotation of the piston converts into simultaneous longitudinal motion of said piston.

4 Claims, 5 Drawing Sheets

FIG. 1 – PRIOR ART
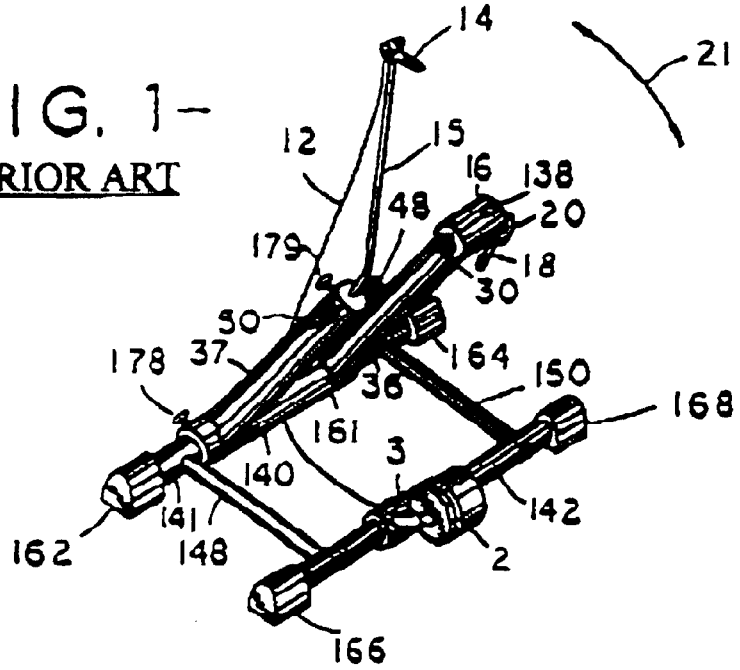
FIG. 2 – PRIOR ART
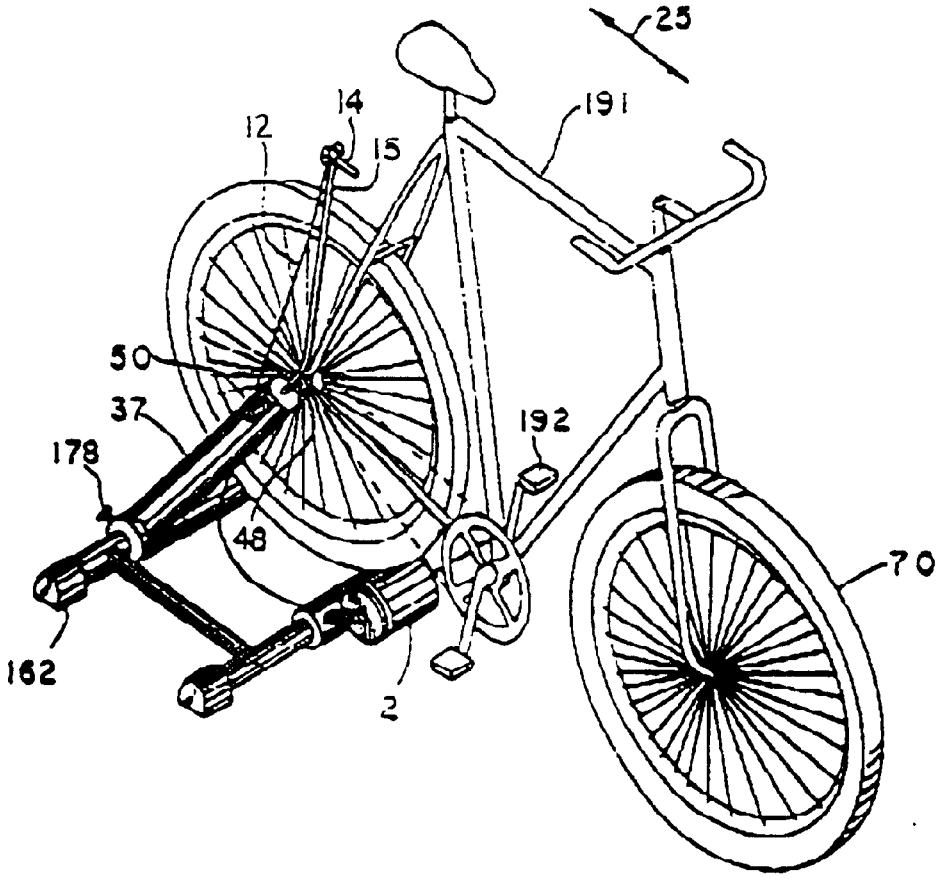

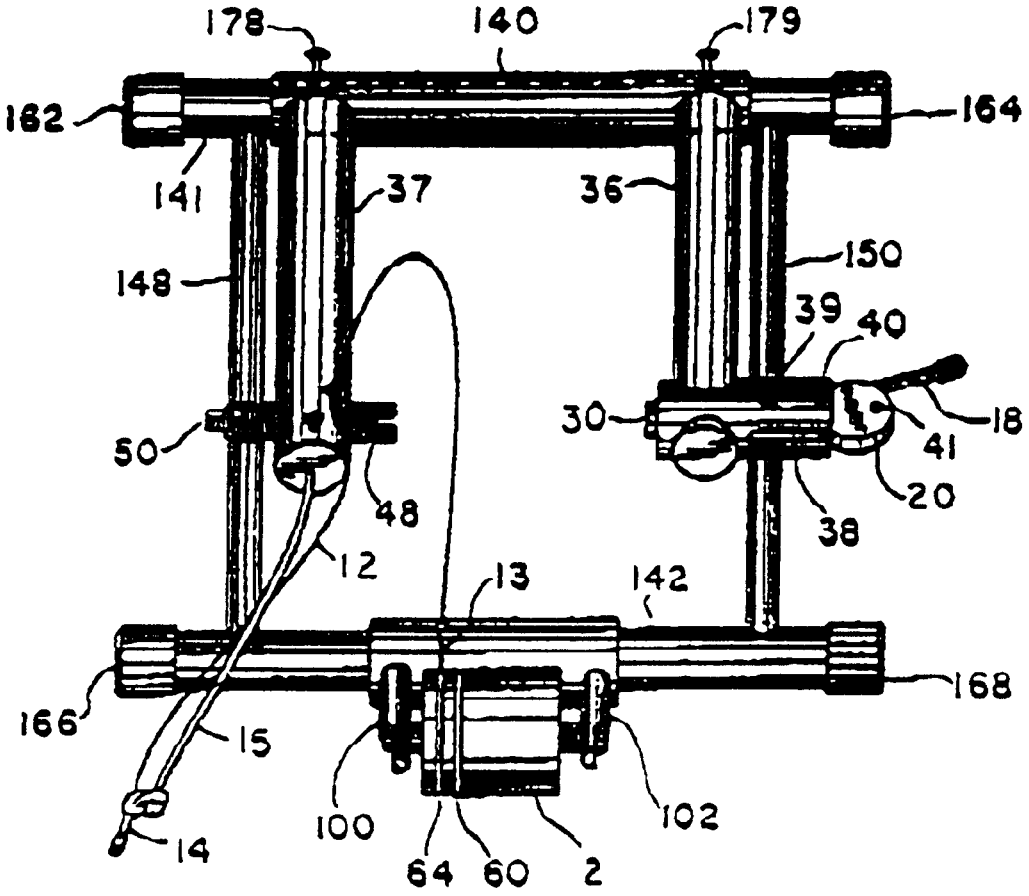
FIG. 3 – PRIOR ART

BICYCLE TRAINER

BACKGROUND OF THE INVENTION

Field of the Invention (Technical Field)

The present invention relates to quick release mechanism for securing and releasing a bicycle in a trainer, wherein said mechanism engages and secures the rear hub area of a bicycle without disassembly of said bicycle.

Reference is made to U.S. Pat. No. 4,969,642 and U.S. Pat. No. 5,152,729, each of which showing such a quick release mechanism comprising:

(a) a housing adapted to slidably receive at least part of a piston, wherein said housing is mounted on a first hub supporting leg of said trainer;

(b) a piston nesting within the housing and being slidable therein, wherein said piston has a first end and a second end, said first end bearing a first means for capturing a bicycle wheel hub;

(c) means for slidably moving said piston within said housing in order to extend said first end toward the hub of a bicycle to secure said bicycle, including a lever mounted at the second end of said piston;

(d) a second means for capturing said bicycle wheel hub, said capturing means being mounted on a second hub supporting leg of said trainer, wherein the hub supporting legs are mutually spaced to allow a bicycle wheel mounted on a bicycle wheel to be located and captured therebetween.

With reference to FIGS. 1, 2 and 3 of the drawings the known quick release mechanism operates as follows:

Referring to FIG. 1, there is shown a frame consisting of a base portion, comprising two mutually spaced front and rear substantially horizontal frame members 141 and 142. Two parallel spacing bars 148 and 150 connect said front and rear base members. Connecting frame members 141 and 142 are substantially horizontal frame members 148 and 150. The connecting of the frame members is performed by any suitable method well-known to those ordinarily skilled in the art. Cushion members 162, 164, 166 and 168 are provided to protect the ends of the frame members 141 and 142 to protect a flat surface having the frame structure resting thereon.

Coaxial sleeve 140 is mounted on the rear base member frame member 141 and is rotatable thereabout. Elements 178 and 179 are bolts to tighten sleeve 140 to frame member 141. Upright frame extensions 36 and 37 (hereafter known as legs) are fixedly and perpendicularly attached to a coaxial member 140. Legs 36 and 37 support a bicycle wheel axle. Once leg position for a particular bicycle is found, then 178 and 179 are tightened and this position is maintained for convenience. If various size bicycles are in constant use, then 178 and 179 are not used.

Quick release means are provided at the terminal end of leg 36. Handle 18 is attached to cam 20. Cam 20 rotates through slot 38 to urge piston 26 having socket 30 located at the end towards the opposed upright leg 37.

Towards the terminal end of leg 37 is a threaded release means 48, 50. Threaded member 50 is rotated to urge the end of the threaded member bearing a socket 48 towards the oppose upright leg 36. Socket 48 is threaded to a distance depending on the bicycle. Once this distance is determined for a particular bicycle, the quick release mechanism is the only thing necessary to operate to engage or disengage the bicycle.

Threaded socket member 48 and cam actuate socket member 30 are adapted to capture and hold securely the hub of a bicycle wheel. Lever 18 is attached in a fixe manner to cam 20.

Referring to FIG. 2, a bicycle is shown mounted on the apparatus of FIG. 1. The rod 15 is shown in close proximity to the seat of the bicycle; this is for easy access by a rider to adjust tension on the roller. As the pedals 192 are rotated by a bicyclist situated on the bicycle of FIG. 2, the rear wheel of the bicycle rotates tensionable roller 2.

Typically, the hub of the bicycle is captured by the sockets 30 and 48, whereupon the legs 37 and 36 are pivoted forward to bring the tire in a resting position upon the roller 2. This method of engaging the axle of a bicycle then pivoting forward and lowering the bicycle to the roller accomplishes two things: one it is the means of accommodating all wheel sizes; and two it saves the step of adjusting the roller to the wheel.

Referring to FIG. 3, there is shown the apparatus of FIG. 1 from an elevated plan perspective. The frame comprises rear member 141 connected to front member 142 by connecting and spacing rods 148 and 150. Coaxial with rear frame 141 and rotatable thereabout is coaxial sleeve 140. Set screws 178 and 179 allow for fixing of the position of coaxial sleeve 140 about rear frame member 141.

It is preferred that the screw socket member 50, 48 be adjusted to capture one side of a bicycle hub whereupon the quick release member having socket 30 may be quickly moved to capture the other side of the bicycle hub.

The above is all known art from U.S. Pat. No. 4,969,642 and U.S. Pat. No. 5,152,729. A drawback of this known prior art is that it suffers from relative complexity and correspondingly high costs of manufacture whilst in use a person operating the known quick release mechanism is liable to get his fingers squeezed between the cam 20 and the slit 38 which is intended to receive cam 20. A further drawback is that the esthetics of the known apparatus suffers from this visibly moving cam 20 moving in and out slit 38 when securing or releasing a bicycle.

SUMMARY OF THE INVENTION (DISCLOSURE OF THE INVENTION)

The quick release mechanism developed by applicant obviates the above drawbacks by applying the features that the housing and the piston have a cooperating groove and protrusion or peg whereby the groove is embodied with a pitch so as to cause that rotation of the piston converts into simultaneous longitudinal motion of said piston.

BRIEF DESCRIPTION OF THE DRAWINGS

The invention shall in the following be further elucidated with reference to the drawings of some exemplary embodiments according to the invention. In the drawings:

FIG. 1 is an elevated perspective of a single bicycle wheel trainer according to the prior art;

FIG. 2 is an elevated perspective showing a bicycle mounted on the apparatus of FIG. 1;

FIG. 3 is a top plan view of the apparatus of FIG. 1;

Similar parts in the figures are referred to with the same reference numerals.

DESCRIPTION OF THE PREFERRED EMBODIMENTS (BEST MODES FOR CARRYING OUT THE INVENTION)

Figure 4:
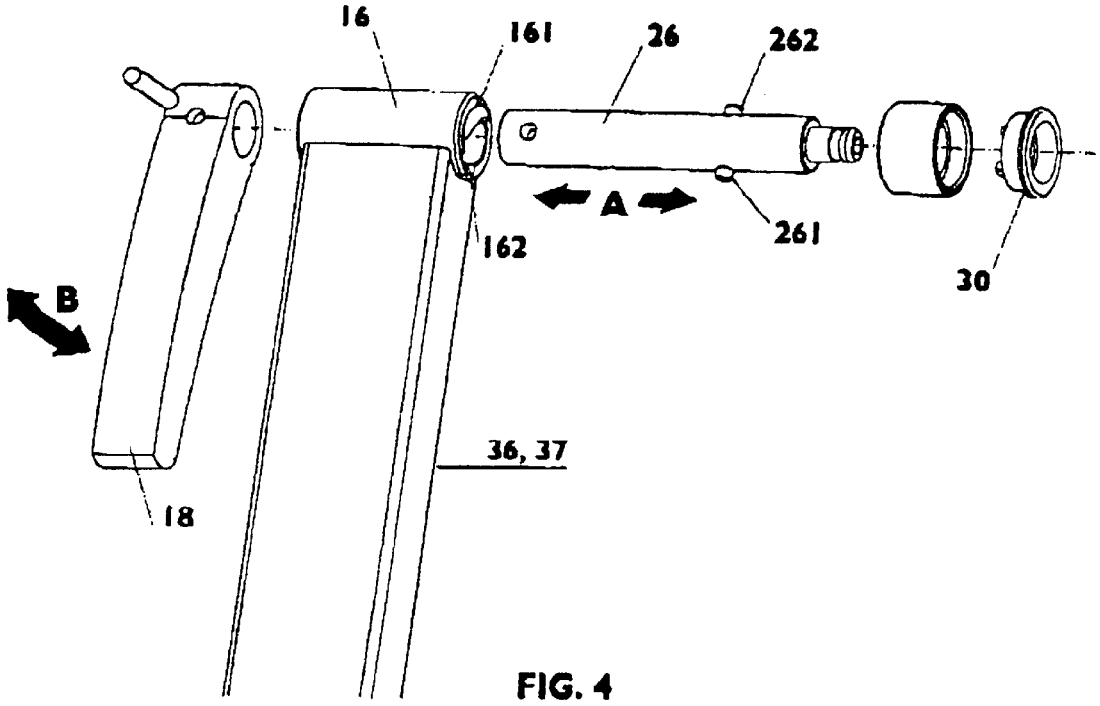
FIG. 4 shows the quick release mechanism of a first embodiment according to the invention in exploded view.
Figure 5:
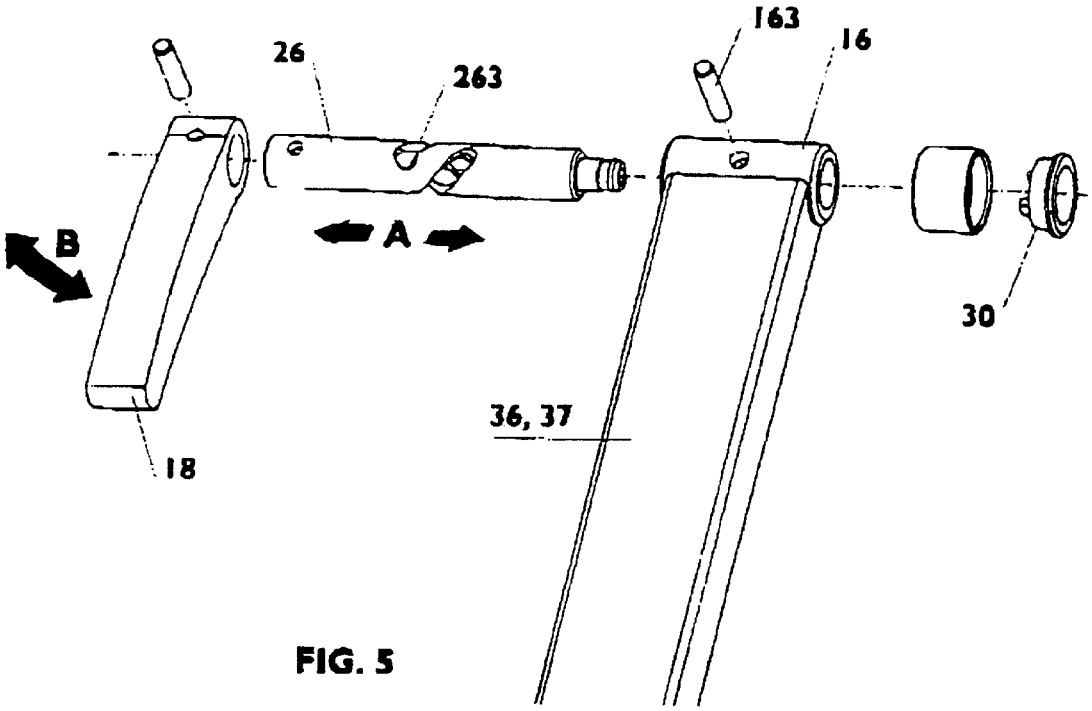
FIG. 5 shows the quick release mechanism of a second embodiment according to the invention in exploded view.
Figure 6:
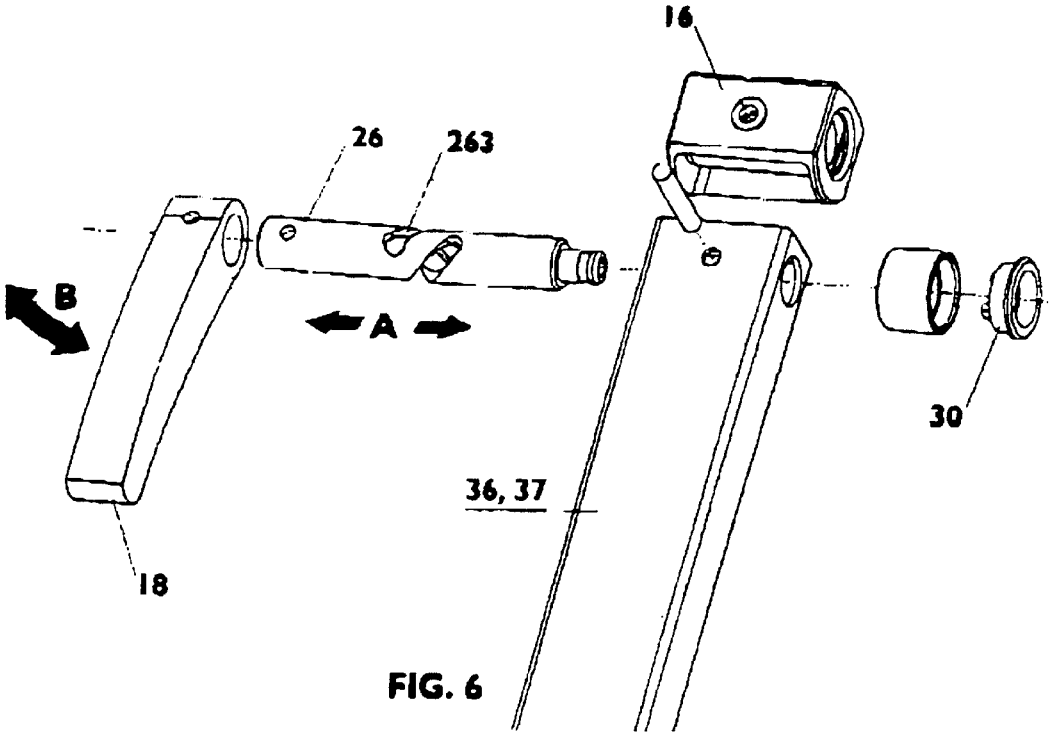
FIG. 6 shows the quick release mechanism according to a third embodiment of the invention in exploded view.

In the drawings, FIGS. 4, 5 and 6 show three preferred embodiments of the quick release mechanism according to the invention as placed on the top end of one of the frame extensions 36 or 37. Within the scope of the invention it is possible to apply the quick release mechanism on both extensions 36, 37, although it suffices if the quick release mechanism is used only on one extension 36 or 37.

The drawings of FIGS. 4, 5 and 6 show that a housing 16 is placed at the extremity of the extension 36 or 37. FIG. 6 shows the embodiment in which the housing is detachable from the extension 36 or 37.

When in assembled condition, the piston 26 is located within the housing 16. FIG. 4 shows the embodiment in which the piston 26 is having at least one protrusion or protrusions 261, 262 or pegs whilst the housing 16 is having a groove or grooves 161,162 that are intended to cooperate with said protrusions 261, 262 of the piston 26. The groove or grooves 161, 162 are embodied with a pitch so as to cause that rotation of the piston 26 with the lever 18 mounted thereon converts the rotative movement of the piston 26 in a concurrent longitudinal movement of the piston 26 in the direction of arrow A. The embodiments shown in FIGS. 5 and 6 operate in a similar fashion; the difference of the embodiments of FIGS. 5 and 6 being explained below.

In the embodiment shown in FIG. 5, a single peg 163 is used that is placed through the housing 16 in order to cooperate with a groove 262 that is part of piston 26.

The embodiment of the quick release mechanism shown in FIG. 6 operates in the same way as the embodiment shown in FIG. 5; the difference being only that housing 16 is detachable from extension 36 or 37.

What is claimed is:

1. A quick release mechanism for securing and releasing a bicycle in a trainer, wherein said mechanism engages and secures the rear hub area of a bicycle without disassembly of said bicycle, comprising:

(a) a housing adapted to slidably receive at least part of a piston, wherein said housing is mounted on a first hub supporting leg of said trainer;

(b) a piston nesting within the housing and being slidable therein, wherein said piston has a first end and a second end, said first end bearing a first means for capturing a bicycle wheel hub;

(c) means for slidably moving said piston within said housing in order to extend said first end toward the hub of a bicycle to secure said bicycle, including a lever mounted at the second end of said piston;

(d) a second means for capturing said bicycle wheel hub, said capturing means being mounted on a second hub supporting leg of said trainer, wherein the hub supporting legs are mutually spaced to allow a bicycle wheel mounted on a bicycle wheel to be located and captured therebetween, wherein (e) the housing and the piston have a cooperating groove and protrusion or peg, whereby the groove is embodied with a pitch so as to cause that rotation of the piston converts into simultaneous longitudinal motion of said piston.

2. A quick release mechanism according to claim 1, wherein the groove is embodied in the housing and the protrusion or peg is connected to the piston.

3. A quick release mechanism according to claim 1, wherein the groove is embodied in the piston and the protrusion or peg is assembled in the housing.

4. A quick release mechanism according to claim 3, wherein the housing is detachable from the first hub supporting leg of said trainer.

* * * * *